United States Patent [19]

Dirksen

[11] 4,310,098

[45] Jan. 12, 1982

[54] PORTABLE BOOM STRUCTURE

[76] Inventor: Larry E. Dirksen, 2114 I-25 Frontage Rd., Erie, Colo. 80516

[21] Appl. No.: 100,916

[22] Filed: Dec. 6, 1979

[51] Int. Cl.[3] ..... B66C 23/38; B66C 23/42; B66C 23/46; B66C 23/82

[52] U.S. Cl. ..... 212/187; 212/195; 212/255; 212/262; 212/265

[58] Field of Search ..... 212/187, 188, 195, 231, 212/239–241, 244, 252, 262–267, 269; 254/326, 335; 52/118, 221, 646

[56] References Cited

U.S. PATENT DOCUMENTS

| | | | |
|---|---|---|---|
| 2,668,625 | 2/1954 | Garland | 212/231 |
| 2,879,902 | 3/1959 | Wilcox | 212/187 |
| 3,423,890 | 1/1969 | Leigh | 52/118 |
| 3,638,806 | 2/1972 | Hippach | 212/231 |
| 3,984,085 | 10/1976 | Bexten | 254/335 |

*Primary Examiner*—Robert G. Sheridan

[57] ABSTRACT

An improved boom structure is provided which is attachable to a vehicle and includes a boom support member for pivotally supporting a telescopic boom. The telescopic boom includes a generally square outer boom and a generally circular inner boom housed within the outer boom but prevented from rotational movement therein. A first winch is connected to the boom support member with a first cable windingly connected to the first winch. Movement of the first cable from about the first winch controls the pivoting of the telescopic boom through an arc of 180 degrees from a generally horizontal position. A second winch is connected to the boom support member with a second cable windingly connected to the second winch. Movement of the second cable from about the second winch controls the extension and retraction of the inner boom relative to the outer boom. A third winch is also connected to the boom support member with a third cable windingly connected to the third winch. Movement of the third cable from about the third winch controls the extension and retraction of the third cable from the outer end of the telescopic boom.

11 Claims, 20 Drawing Figures

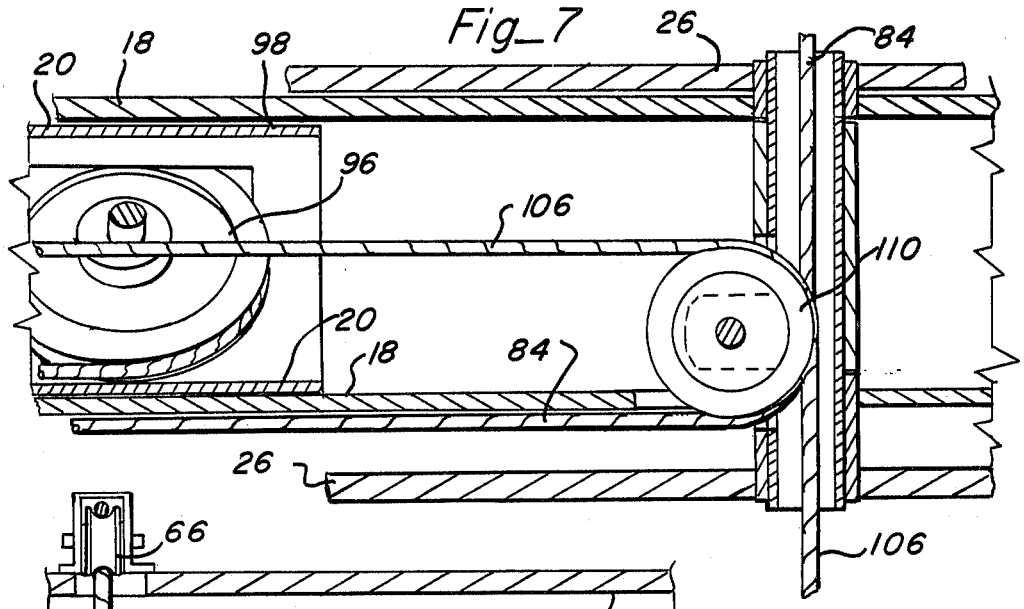
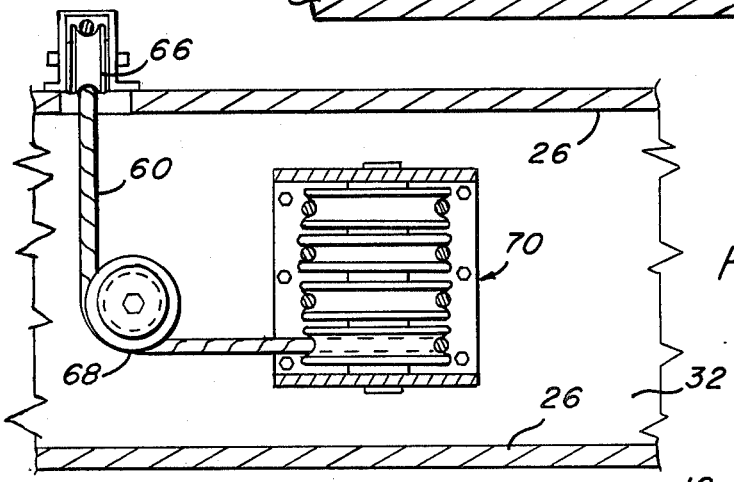
Fig_8
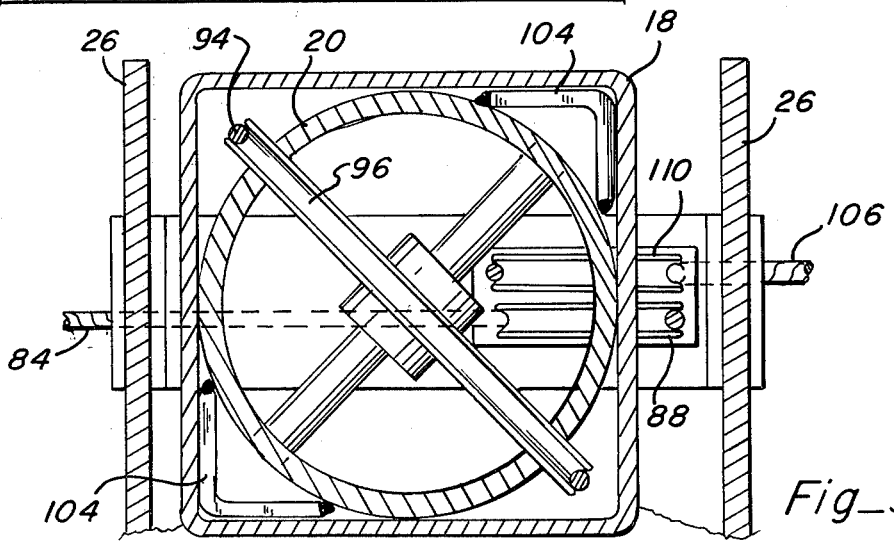
Fig_9

PORTABLE BOOM STRUCTURE

FIELD OF INVENTION

This invention relates to crane structures and, in particular, to an improved portable boom structure which is readily attachable to a relatively small towing vehicle for easy movement thereof.

BACKGROUND ART

A number of patent references relate to boom structures. In both U.S. Pat. No. 2,508,835 to Moon, et al. and U.S. Pat. No. 2,331,559 to McEwan, a telescoping boom structure is disclosed. Cables extend from the tops of the lower boom member about pulleys at the bottom of the extendable boom member, back around pulleys positioned at the tops of the lower boom members, and back to a winch. In U.S. Pat. No. 3,423,890 to Leigh, a structure is described wherein a frame having rollers is provided about a circular inner boom member which will prevent the rotation of the circular boom member within an outer square boom member. In U.S. Pat. No. 2,515,833 to Mueller and U.S. Pat. No. 2,593,764 to Kaunitz, portable hoisting devices are shown which are attachable to moving vehicles.

DISCLOSURE OF THE INVENTION

In accordance with this invention, an improved boom structure is provided including a boom support member mounted on wheels for moving the boom structure while attachable to a towing vehicle. A telescopic boom is pivotally attached to the support member for pivotal movement through an arc of 180 degrees from a horizontal position. A first winch is connected to the support member and includes a tackle having a first cable for pivoting the boom about the support member. A second winch is also connected to the support member and includes an inner pulley and a second cable for extending and retracting the boom. A third winch is connected to the support member and includes a third cable for extending and retracting a hook or engaging member.

More particularly, a telescopic boom is provided including a generally square outer boom and a generally circular inner boom movably housed therein. A pair of angle irons are connected to the outer surface of the inner boom adjacent the interior corners of the outer boom to prevent the inner boom from rotating within the outer boom and prevent unwanted extension of the inner boom from the outer boom. The telescopic boom is pivotally supported on a boom support member. The support member includes a pair of side plates and a back plate. Mounting plates are connected to the side plates and are generally trapezoidal shaped with the shorter side directed downwardly. The support member is mounted on wheels for easy towing by a vehicle which is attached to the support member by an elongated frame.

A first winch is connected to a first mounting plate. A first cable is windingly connected to the first winch and extends through a tackle connected within the interior of the support member. The boom is pivotable from a generally horizontal position through an arc of 180 degrees by means of the first cable which is rotatably moved about the first winch. A second winch is also connected to the first mounting plate. A second cable is windingly connected to the second winch and extends around a second winch pulley and an inner pulley to be connected to a cable connector. The inner boom is movable relative to the outer boom by means of the second cable movement through the rotating action of the second winch. A third winch is connected to a second mounting plate. A third cable is windingly connected to the third winch and extends around a third winch pulley through the inner boom and exits the outer end of the telescopic boom. An object engaging member is attached to the end of the third cable and is positioned between a first rim member and a second rim member for grasping objects to be hoisted or pulled.

Based on the foregoing, a number of worthwhile advantages of this invention are readily discernable. An improved boom structure is provided which is attachable to a relatively small vehicle for movement. Significantly, the boom structure can be used for generally light weight hoisting jobs in areas such as agriculture, small machinery shops, and small building construction. The present invention also has important utility in underground work, such as in mining operations, where a relatively small lifting apparatus with an easy disassembly feature is extremely beneficial. The boom structure is simply constructed and is inexpensively made compared with the crane structures used on large construction sites. Thus, the invention herein described is available on the individual owner as well as small business. The telescopic boom is pivotable through a 180 degree arc to facilitate access to the object to be lifted. The inner boom has angle irons attached to its outer surface to prevent its rotation with respect to the outer boom. In addition, the unique boom support is connectable to either single or dual axis wheels and is also attachable to a multi-point hitch on the back of a tractor. Furthermore, the wheels include a telescopic feature to provide additional stability when lifting loads. The boom is also easily operable and constructed for longlasting and continuous use. Additional advantages of this invention will be apparent from the following description taken in conjunction with the accompanying drawings.

BRIEF DESCRIPTION OF THE DRAWINGS

FIG. 7 is an enlarged, fragmentary, longitudinal section taken along line 7—7 of FIG. 6, showing details of the placement of the second and third cables and the inner pulley within the inner boom;

FIG. 8 is an enlarged, fragmentary, longitudinal section, taken along line 8—8 of FIG. 6, showing details of the tackle for pivoting the boom;

FIG. 9 is an enlarged, fragmentary, lateral section, taken along line 9—9 of FIG. 6, showing details of the inner boom within the outer boom and the angle irons attached to the inner boom;

DESCRIPTION OF THE PREFERRED EMBODIMENT

Figure 1:
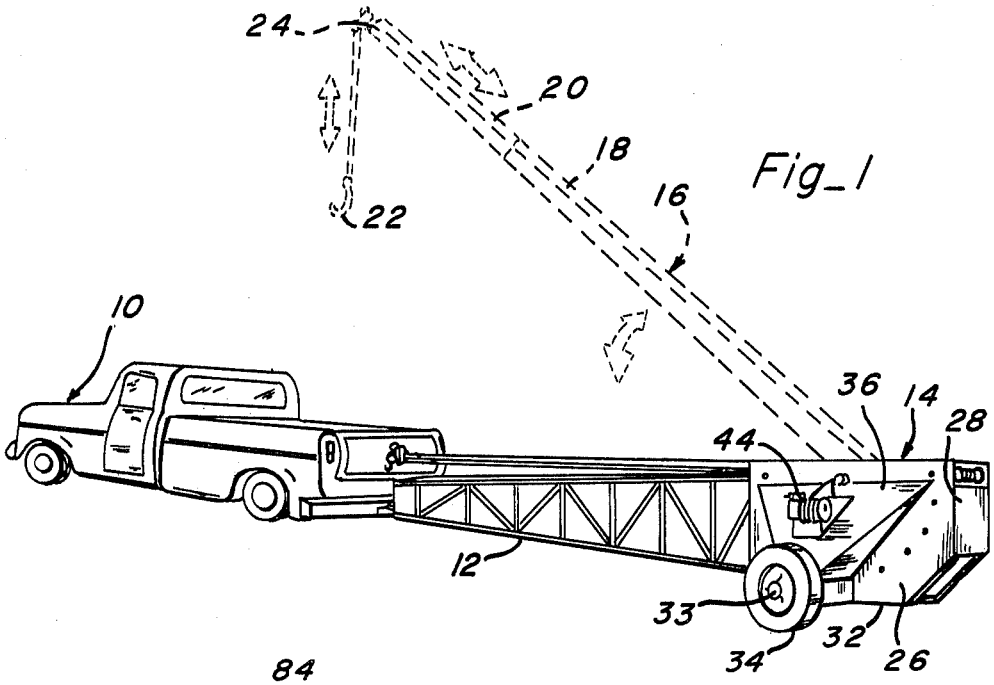
FIG. 1 is a perspective view of a first embodiment of the improved boom structure of this invention mounted on a pair of wheels and attached to a vehicle.

In accordance with this invention, a first embodiment of an improved boom structure is shown in FIG. 1 attached to a small truck or vehicle 10 by an elongated frame 12. The boom structure includes a boom support member 14 and a telescopic boom 16 which includes three types of movement, as illustrated by the arrows. The telescopic boom 16 is pivotable through an arc of 180 degrees from a generally horizontal position. The telescopic boom 16 includes an outer boom 18 and an inner boom 20 which is extendable and retractable within outer boom 18. An engaging member or hook 22 is located outwardly of the first or outer end 24 of telescopic boom 16 and is movable vertically to grasp and hold an object to be moved or hoisted.

Figure 2:
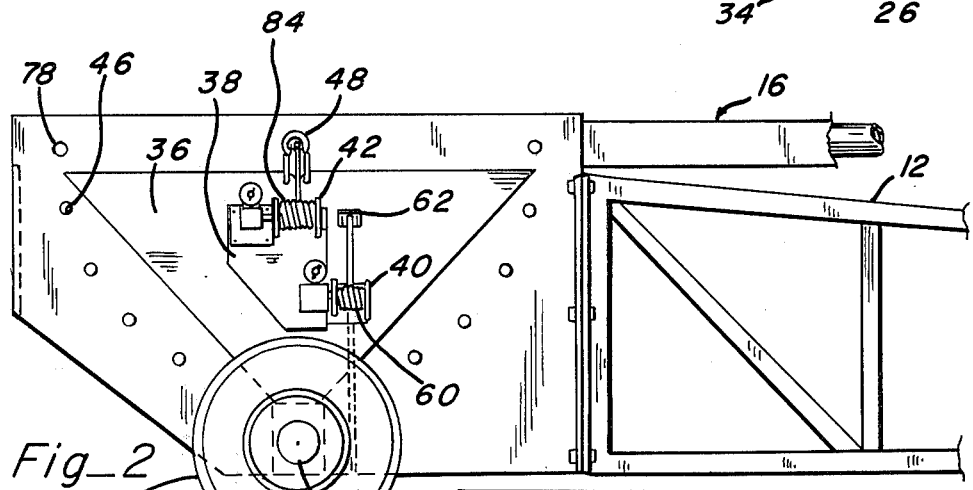
FIG. 2 is a side elevational view showing the boom support member with the first and second winches mounted thereon.
Figure 5:
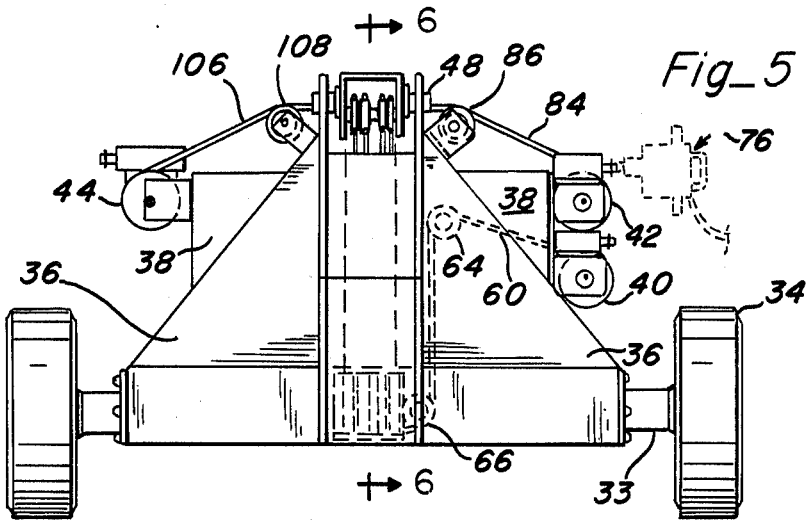
FIG. 5 is a rear, elevational view of the improved boom structure mounted on wheels showing the attachment of the first, second, and third winches to the boom support member.

As seen in FIGS. 1 and 2, the support member 14 includes a pair of side plates 26 joined together by a back plate 28 with a bottom plate 32 adjacent the surface over which support member 14 is supported. In one embodiment, a single axle 33 extends transversely through the side plates 26 and has a pair of wheels 34 connected at its ends to maintain support member 14 above the support surface and provide easy movement thereof when towed by the vehicle 10. It can be appreciated that a dual axis wheel arrangement could also be used as well as a multi-point hitch on the back of a tractor to support the boom support member 14. A mounting plate 36 is connected to each side plate 26. Mounting plate 36 is shaped generally like a trapezoid with the shorter side thereof extending downwardly in the direction of the bottom plate 32. The thickness or lateral extent of the mounting plate 36 increases such that the thickness thereof is greater at the shorter side of the trapezoid shape than at the opposite, relatively longer side of the trapezoid shape. As also depicted in FIG. 5, a mounting block 38 is joined to each of the side plates 26. A first winch 40 is fastened to a mounting block 38 on a first side plate 26 while a second winch 42 is also fastened to the mounting block 38 on the first side plate 26 vertically above the first winch 40. A third winch 44 is fastened to a mounting block 38 on a second side plate 26. Each of the side plates 26 further includes a number of locking holes 46 which are formed therein in a generally circular arc about pivot pin 48. Pivot pin 48 extends transversely through the side plates 26 above the axle 33 and provides support for telescopic boom 16 in boom support member 14. Pivot pin 48 is the point about which telescopic boom 16 pivots in its 180 degree path. The end of the support member 14 opposite the rear end thereof is connected to one end of the frame 12 by conventional means, such as bolts. The opposite end of frame 12 is attached to the vehicle 10 by a frame pin 50 inserted through coaxial holes in tongues extending from the frame end and the vehicle rear end.

Figure 3:
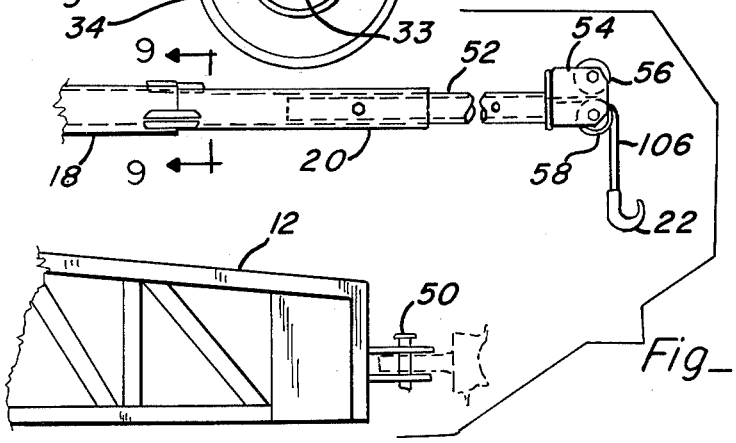
FIG. 3 is a fragmentary, side view of portions of the frame connected to the vehicle with portions of the telescopic boom extending thereover.
Figure 4:
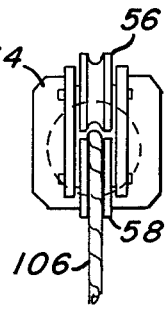
FIG. 4 is a fragmentary, end view of the boom showing the first and second rim members with the third cable extending downwardly therebetween.

Typically, as illustrated in FIG. 3, a jib boom 52 is also connected within the interior of outer boom 18 by means of a bolt 30 inserted through a hole in the jib boom 52, aligned with a hole in the inner boom 20. A rim support 54 is connected to the outermost end of the jib boom 50, as shown in FIG. 4. A first rim member 56 and a second rim member 58 are connected in spaced relation from one another to rim support 54. A cable having the hook 22 at an end thereof is received between the rim members 56, 58. When the outer end 24 of telescopic boom 16 rotates through a first arcuate path of approximately 90 degrees, the cable overlies first rim 56. When the outer end 24 of telescopic boom 16 rotates through a second arcuate path which is the remaining 90 degrees of the 180 degree arcuate path, the cable overlies the second rim 58. Consequently, the object engaging member 22 is supported by the rim members 56, 58 throughout the 180 degree arc of telescopic boom 16.

Figure 6:
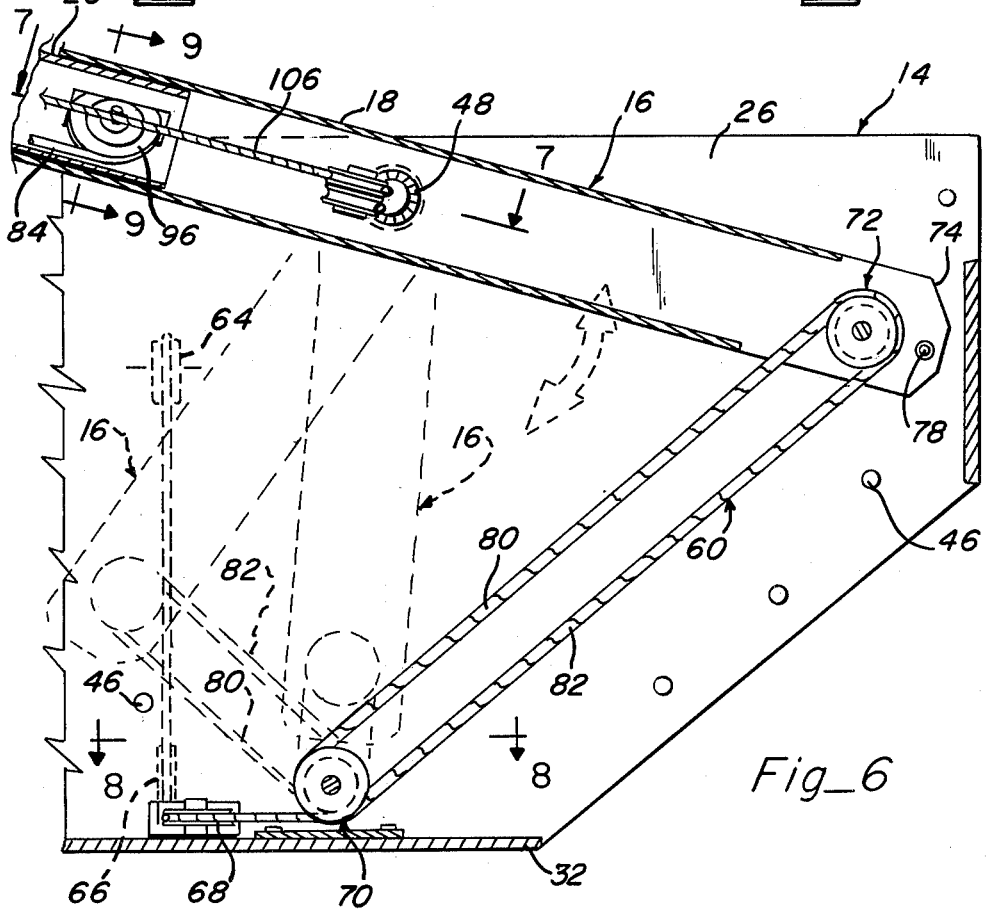
FIG. 6 is a fragmentary, longitudinal section taken along line 6—6 of FIG. 5 showing the tackle for pivotal movement of the boom.
Figures 10, 11, 12:
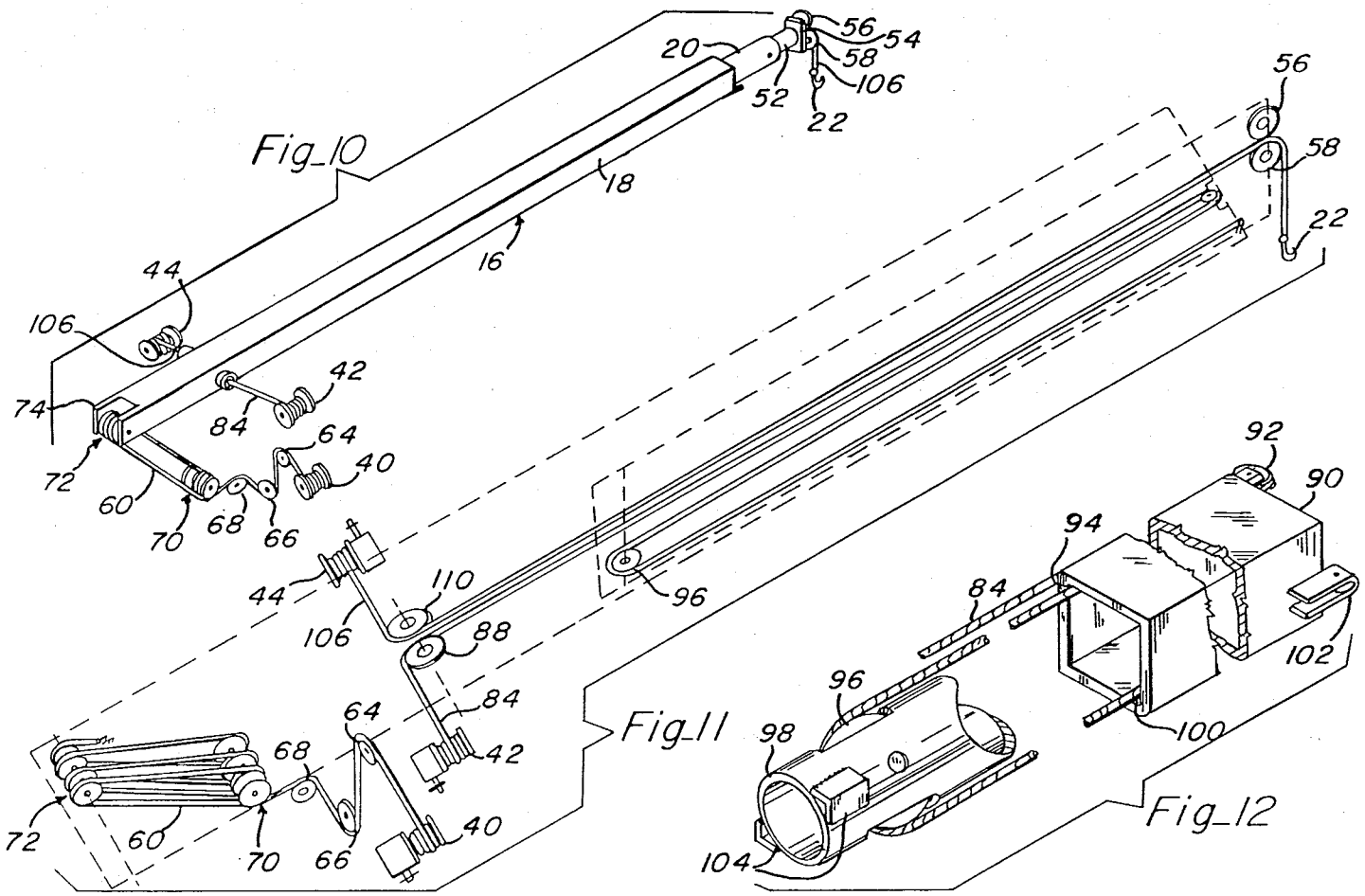
FIG. 10 is a perspective view of the improved boom structure without the boom support member.
FIG. 11 is an exploded view of the first embodiment of the improved boom structure showing details of the first, second, and third cables for pivotable movement of the boom, extension and retraction of the inner boom, and movement of the hook, respectively.
FIG. 12 is a fragmentary, perspective view of the inner and outer booms of the first embodiment with parts thereof cut away to expose further details of the second cable path.

Referring initially to FIGS. 2 and 6 to discuss the pivotal movement of telescopic boom 16, it is seen that a first cable 60 is wound about first winch 40. First cable 60 passes through a first winch opening 62 in first side plate 26. Although the path of first cable 60 is illustrated by the hidden lines of FIG. 5, the path of cable 60 is best seen in FIG. 11. The first cable 60 extends from first winch opening 62 over an inside pulley 64 downwardly over an outside pulley 66. Inside pulley 64 is positioned interiorly of support member 14 while outside pulley 66 is connected to the support member 14 exteriorly thereof. First cable 60 continues its extension from outside pulley 66 about bottom pulley 68. From bottom pulley 68, first cable 60 proceeds over a lower pulley which forms a part of a first winch lower pulley set 70, as seen in FIG. 8. The first cable 60 then extends upwardly over an upper pulley which forms a part of first winch upper pulley set 72. First winch lower pulley set 70 is fastened to bottom plate 32 while first winch upper pulley set is connected to an inner or second end 74 of telescopic boom 16. The first cable continues downwardly and subsequently upwardly about a number of such pulleys in first winch upper and lower pulley sets 70, 72 until first cable 60 ends adjacent inner end 74. The first winch upper and lower pulley sets 70, 72 comprise a tackle for gaining a mechanical advantage in hoisting.

In operation, a hand-crank or, conveniently, a reversible power drill 76 or other suitable power source is connected to the first winch 40. If, as shown in FIG. 6, the telescopic boom 16 is positioned extending generally in a first direction towards the front of boom support member 14 and vehicle 10, the drill 76 is actuated such that first cable 60 is wound around first winch 40 thereby shortening the distance between first winch upper pulley set 72 and first winch lower pulley set 70 since portions of first cable 60 are wrapped around first winch 40. It being understood that locking pin 78 is removed from the locking hole 46 and the aligning hole formed in the inner end 74 of telescopic boom 16 prior to the pivotal movement of telescopic boom 16. Once the telescopic boom 16 is in the desired raised position with a locking hole 46 coaxial with the hole at the inner end 74, the telescopic boom 16 may be fixedly secured in that position by inserting the locking pin 78 through the aligned holes. As depicted by the dotted line configuration in FIG. 6, the telescopic boom 16 can be raised eventually to a generally straight vertical position so that telescopic boom 16 has traveled through an arc of 90 degrees from its original horizontal position. The momentum of the telescopic boom 16 enables it to continue its pivotal movement towards the opposite horizontal position in the direction of the rear of boom support member 14 and away from vehicle 10. If the momentum of the telescopic boom 16 is insufficient, a slight force can be applied to move it from its vertical position in the direction of the rear of boom support member 14. The application of drill 76 or other power source can then be reversed so that, rather than winding first cable 60 around first winch 40, first cable 60 is unwound from first winch 40. The increased cable available along with the force of gravity results in the lowering of telescopic boom 16. Correspondingly, first winch upper pulley set 72 passes over first winch lower pulley set 70 in the direction of the front of the boom support member 14 towards the vehicle 10. First portion cable 80 of first cable 60 is now positioned below the second portion cable 82 of first cable 60, whereas previously, when telescopic boom 16 extended in the direction towards the front of support member 14, first portion cable 80 was above second portion cable 82. Telescopic boom 16 is pivotable until it extends horizontally in a direction opposite from the original horizontal position, thereby completing the arc of 180 degrees. As before, locking holes 46 are provided to receive the locking pin 78 to secure the telescopic boom 16 in place. To return the telescopic boom 16 to its original horizontal position extending away from the rear of support member 14 and toward vehicle 10, the above-described procedure is followed with the initial winding of first cable 60 to raise telescopic boom 16 to a center vertical position and then unwinding first cable 60 to lower telescopic boom 16 to a generally horizontal position extending towards vehicle 10.

Referring again to FIGS. 2 and 6 to consider the movement of inner boom 20 within outer boom 18, it is seen that a second cable 84 is wound around second winch 42. Second cable 84 is received over a first side pulley 86 and then continues into an opening formed through pivot pin 48. As previously noted, telescopic boom 16 includes outer boom 18 and inner boom 20. Outer boom 18 is generally square-shaped in cross section while inner boom 20 is generally circular-shaped in cross section. The outer diameter of the generally circular-shaped inner boom is just sufficiently less than the inside dimension of outer boom 18 so that inner boom 20 is slidably received therein. The path of second cable 84 is best illustrated in FIG. 11. The second cable 84, after passing into the opening formed in pivot pin 48, moves over second winch pulley 88 which is positioned generally parallel to the longitudinal plane of telescopic boom 16 so that second cable 84 proceeds therefrom exteriorly of outer boom 18, as seen in FIG. 7. The second cable 84 then extends outside of outer boom 18 until it reaches outer end 90 of outer boom 18 and moves over sheave 92 which is connected to outer end 90 at a corner thereof and proceeds back towards boom support member 14 through outer boom 18. At this point, second cable 84 is located along a first interior corner 94 of outer boom 18 but outwardly of inner boom 20, as shown in FIG. 12. Second cable 84 continues around inner pulley 96 which is attached adjacent an inner or first end 98 of inner boom 20. Inner pulley 96 is positioned so that second cable 84 continues along a second interior corner 100 of outer boom 18 which is diagonally opposite first interior corner 94. Second cable 84 continues until it reaches the outer end 90 of the outer boom 18 where it is fastened to cable connector 102 which is located along a corner which is diagonally opposite the corner to which sheave 92 is connected. The diagonal placement of inner pulley 96 in inner boom 20 is depicted in FIGS. 7 and 9. In addition, a pair of generally L-shaped angle members 104 are connected by welding to the outer surface of inner boom 20 so that there is sliding engagement between each angle iron 104 and an interior corner of outer boom 18. The interior corners of outer boom 18 which engage the angle irons 104 are those corners which do not receive second cable 84 thereadjacent. Angle members 104 are positioned between outer boom 18 and inner boom 20 to prevent rotational movement of inner boom 20 within outer boom 18.

In operation, a hand-crank or the drill 76, as illustrated in FIG. 5, is attached to second winch 42. Winding of second cable 84 around second winch 42 by drill 76 results in decreasing the distance between inner pulley 96 and outer end 90 of outer boom 18 since there is less of second cable 84 therebetween. Consequently, inner boom 20 increasingly extends outwardly of outer boom 18 as additional winding of second cable 84 occurs about second winch 42. Conversely, as second cable 84 is released or unwound by drill 76 from second winch 42 to provide additional portions of second cable 84 within telescopic boom 16, inner boom 20 retracts or slides inwardly into outer boom 18.

Referring again to FIG. 6 to discuss the movement of hook 22, it is seen that third winch 44 is fastened to a mounting block 38 which is mounted on a mounting plate 36 on second side plate 26. A third cable 106 is wound around third winch 44 and moves over a second side pulley 108 fastened outwardly of the boom support member. The third cable 106 continues into the opening formed in pivot pin 48 but in an opposite direction from that of the second cable 84. As illustrated in FIG. 11, third cable 106 continues about third winch pulley 110. As seen in FIG. 6, third winch pulley 110 is axially aligned and coextensive with second winch pulley 88 and is positioned in telescopic boom 16 such that third cable 106 proceeds generally through the center of the longitudinal axis of inner boom 20. Third cable 106 exits the outer end 24 of telescopic boom 16 and hook 22 is attached to the end thereof for grippingly engaging objects to be lifted or pulled.

In operation, a hand-crank or the power drill 76 is connected to third winch 44. To move third cable 106 so that it extends increasingly downwardly, third cable 106 is unwound from third winch 44. Conversely, to retract third cable 106 towards or into inner boom 20, third cable 106 is wound or wrapped around third winch 44 to decrease the length of third cable extending through inner boom 20.

Figure 13:
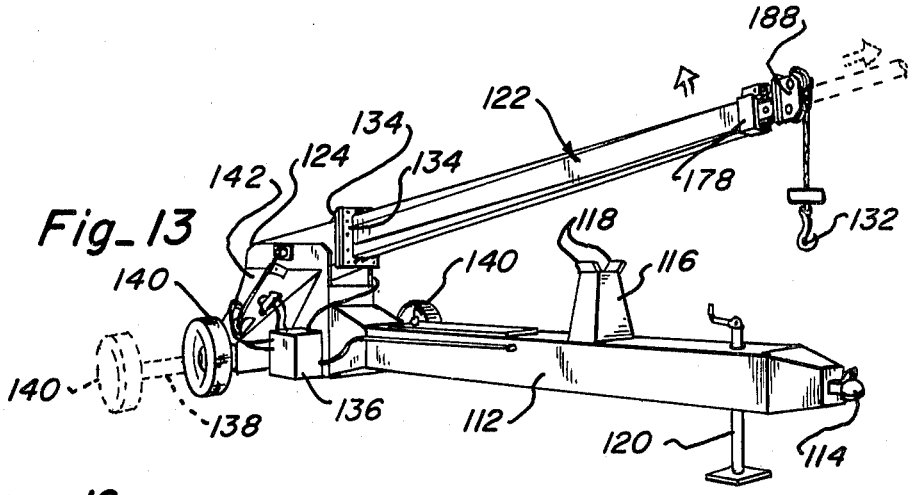
FIG. 13 is a perspective view of a second embodiment of the improved boom structure of this invention.

A second embodiment of the improved boom structure and features thereof are illustrated in FIGS. 13–20. As seen in FIG. 13, the boom is connected to a frame 112 at a first end thereof. The frame 112 has a solid outer wall. A socket member 114 is mounted on a second end of frame 112 for engaging a standard towing ball. A support stand 116 is joined to the upper portion of the frame 112 and has a pair of diverging sheets 118 for holding a telescopic boom 122. A support leg 120 is also connected to frame 120 adjacent socket member 114 and is used to support frame 112 above the surface when attaching the frame 112 to a towing vehicle.

The significant differences between the first and second embodiments of the present invention are the use of a hydraulic configuration to move the telescopic boom 122 and cables, the cable arrangement for extending or retracting the telescopic boom 122, and the means for minimizing rotational movement of the inner boom within the outer boom. As a consequence, these features will be described in detail while it is readily understandable that features discussed with respect to the first embodiment are also applicable in the second embodiment. In addition, no locking holes or locking pin are provided with the boom support member 124 in this embodiment.

Figure 15:
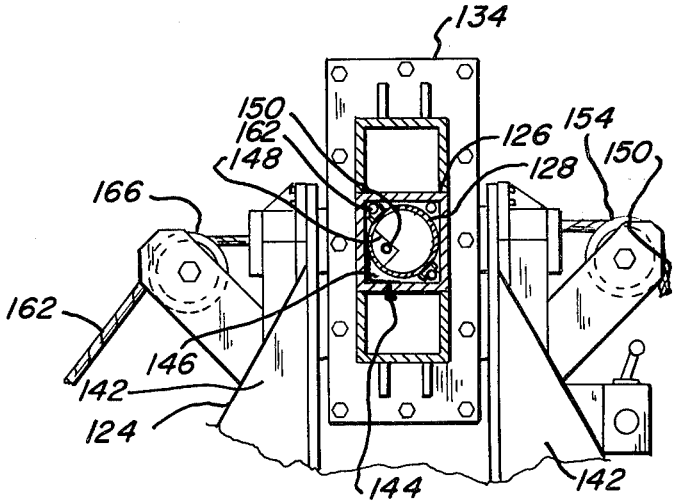
FIG. 15 is an enlarged, fragmentary, lateral section, taken along line 15—15 of FIG. 14, showing details of the cable path for extending or retracting the inner boom.
Figure 16:
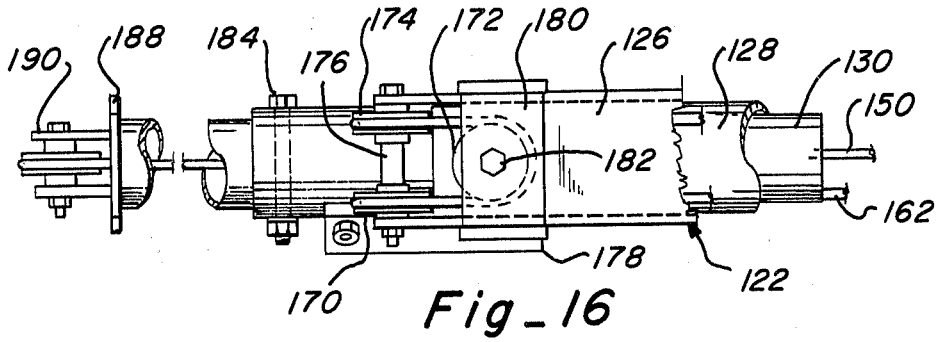
FIG. 16 is an enlarged, fragmentary, longitudinal section, taken along line 16—16 of FIG. 14, showing details of the cable arrangement adjacent an end of the inner boom for extending or retracting the inner boom.
Figure 17:
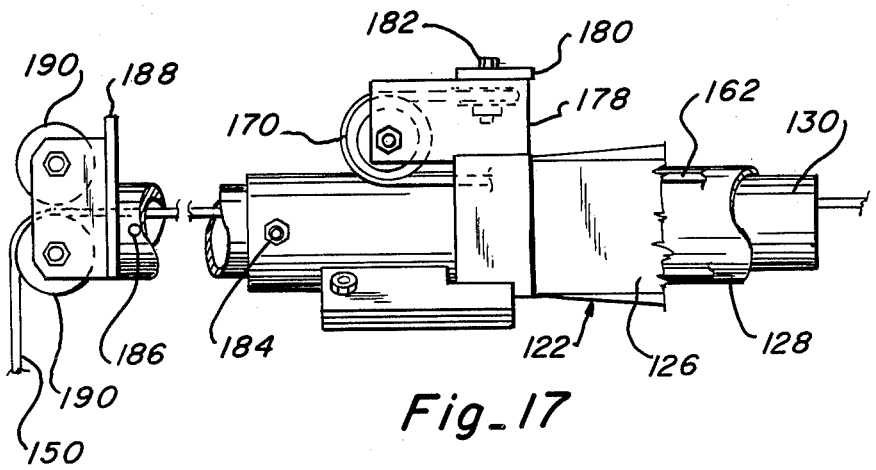
FIG. 17 is an enlarged, fragmentary, side view showing details of the cable arrangement adjacent an end of the inner boom for extending or retracting the inner boom.

The telescopic boom 122 includes an outer boom 126 and an inner boom 128, as seen in FIGS. 16 and 17. A jib boom 130 is supported within inner boom 128. A hook 132 extends from jib boom 130 for engaging objects to be lifted or carried. The outer boom 126 tapers from where it is connected to boom support member 124 and is readily formed by combining a pair of substantially triangular shaped beam pieces so that a generally rectangular or square cross sectional shape is provided. As depicted in FIGS. 13 and 15, the telescopic boom 122 is fastened to boom support member 124 by a pair of flanges 134 having aligned holes along their periphery to receive bolts. The bolts are removable so that the telescopic boom 122 is easily disassembled from the boom support member 124. After the cables in the telescopic boom 122 are removed therefrom, the telescopic boom 122 is completely disconnected from the boom support member 124.

Figure 14:
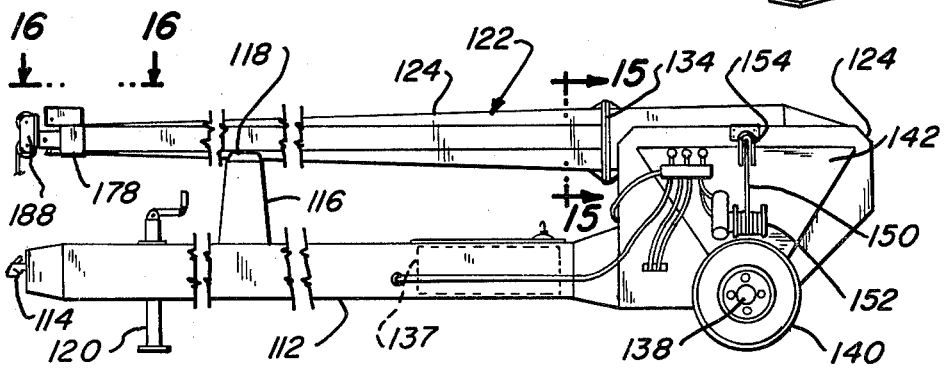
FIG. 14 is a side elevational view showing an hydraulic arrangement for rotating the winches.

Similar to boom support member 14, the boom support member 124 is depicted in FIGS. 13–15 as also having three winches mounted thereon. Rather than using a power drill or manually rotating the winches, a hydraulic system is provided powered by a standard engine contained in housing 136. The hydraulic fluid is housed in a reservoir 137 provided in frame 112, as illustrated in FIG. 14. As a consequence of this placement, the fluid acts as a counter weight to a load being lifted by hook 132 to enable the boom structure to raise even greater weighted loads. The use of a hydraulic system to provide the cable movement is conventional and known to one skilled in the art. Hence, the details of the hydraulic equipment itself will not be discussed.

Also illustrated in FIG. 13 is the telescoping feature of the axle 138 which supports a pair of wheels 140. The axle 138 and wheel 140 move laterally and act as outriggers to provide additional support when the boom structure is lifting heavy loads. The telescoping is achieved by using an inner axle receivable within an outer axle and having aligned holes therein to receive a locking pin. Although not shown, hydraulic powered outriggers could also be used and placed at appropriate points on the frame 112 and boom support member 124 to further stabilize and support the boom structure during the lifting of loads. The boom support member 124 is essentially the same as previously described with regard to the first embodiment except that no mounting blocks for mounting winches thereon are provided. Rather, the hydraulic motors are attached directly to mounting plates 142.

Also shown in FIG. 15 is a face plate 144 contained within outer boom 126 and joined to inner boom 128. Face plate 144 is generally circular in cross section to conform to and contiguously contact the inner boom 128. However, face plate 144 also includes an ear portion 146 which extends into an interior corner of outer boom 126. Ear portion 146 tapers so that it is readily positioned adjacent the interior corner. Consequently, not only does ear portion 146 substantially minimize rotational movement of inner boom 128 within outer boom 126 but, when it is desirable to extend or retract inner boom 128 relative to outer boom 126, ear portion 146 substantially minimizes friction forces to facilitate such movement of inner boom 128. Thus, ear portion 146 functions similarly to the previously described angle irons 104. Further, although not shown in the figures, it is understood that means are provided adjacent the end of outer boom 126 to prevent the unwanted exiting of inner boom 128 from outer boom 126. Such means, preferably, contacts ear portion 146 to prevent further outward movement of inner boom 128. Also, an angle iron 104 could be connected to the exterior surface of the ear portion 146. The face plate 144 also includes a window 148, located adjacent ear portion 146. Window 148 is provided to receive therethrough hook cable 150 which is connected to hook 132. Hook cable 150 is woundingly received about wince 152 and extends therefrom to about first side pulley 154.

Figure 18:
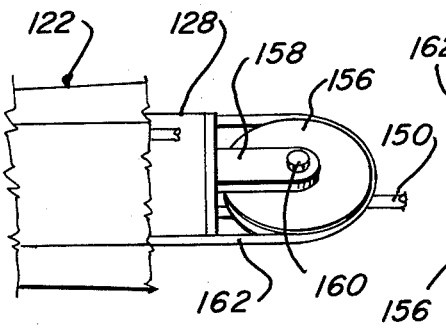
FIG. 18 is an enlarged, fragmentary, longitudinal section showing the inner pulley of the second embodiment.
Figure 19:
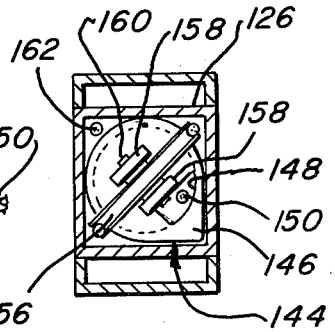
FIG. 19 is an enlarged, lateral section showing the inner pulley and a face plate surrounding the inner boom to prevent rotation of the inner boom within the outer boom.
Figure 20:
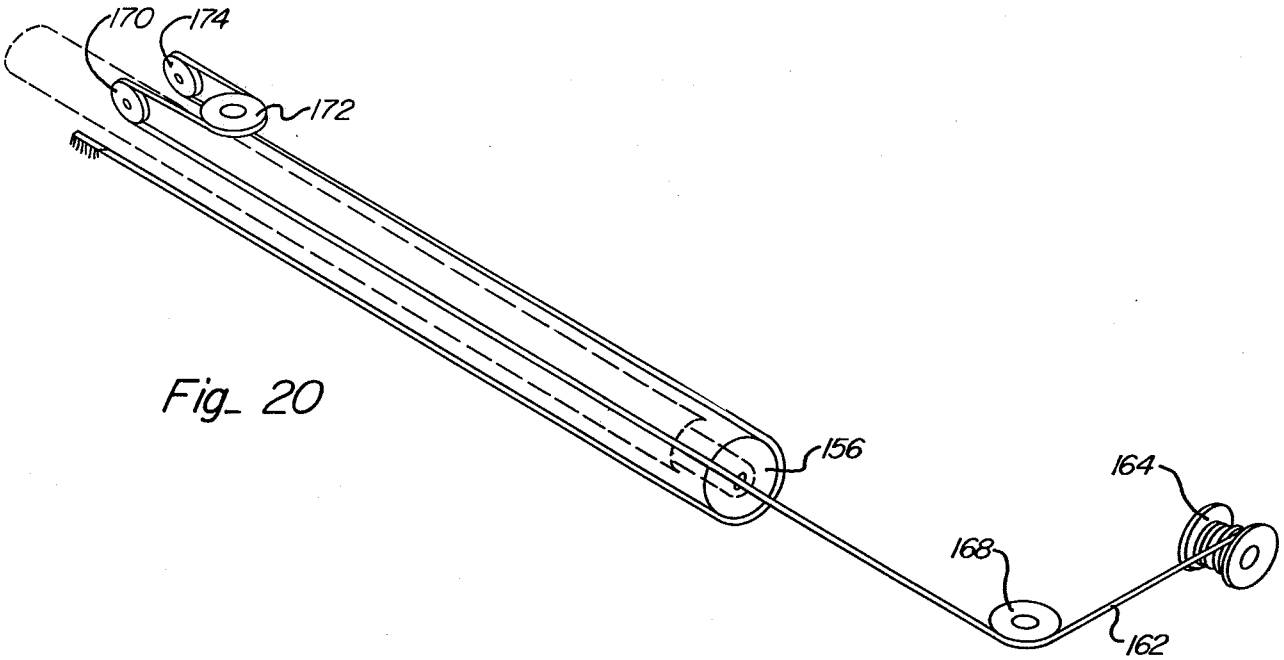
FIG. 20 is an exploded view of the second embodiment showing the cable path for extending or retracting the telescopic boom.

Positioned diagonally within outer boom 126 is inner pulley 156. Inner pulley 156 is joined to inner boom 128, as best depicted in FIGS. 18 and 19. A pair of clamping elements 158 connect to inner boom 128 and extend therefrom to generally the center or midportion of inner pulley 156 and on opposite sides thereof. The two clamping elements 158 are fastened together by a rod 160 to connect inner pulley 156 to inner boom 128. Inner pulley 156 is located to receive cable 162 which extends or runs along the interior corners of outer boom 126. The path of cable 162 is best seen in FIG. 20. Cable 162 is woundingly received about winch 164. As indicated in FIG. 15, but not FIG. 20, cable 162 is received by second side pulley 166. From second side pulley 166, the cable 162 extends to a winch pulley 168 located within telescopic boom 122. Winch pulley 168 is generally parallel to telescopic boom 122 such that cable 162 is positioned thereabout to be directed within outer boom 126 along a first interior corner thereof, as seen in FIGS. 15 and 19. Cable 162 passes therealong until it reaches first return pulley 170. Cable 162 then extends in an opposite direction for a relatively short distance where it contacts lateral pulley 172. The plane of lateral pulley 172 is generally perpendicular to the plane of first return pulley 170. The cable 162 is then positioned about lateral pulley 172 and extends therefrom towards the outer end of outer boom 126. Cable 162 is received by second return pulley 174 and moves in an opposite direction along a second interior corner of outer boom 126 towards inner pulley 156. The second interior corner is directly across from the first interior corner. Cable 162 joins with inner pulley 156 along the second interior corner and extends about inner pulley 156 until it is adjacent a third interior corner of outer boom 126. The third interior corner is diagonally opposite the second interior corner. The cable 162 then extends along the third interior corner to adjacent the outer end of outer boom 126 where it is attached by conventional means. In view of the foregoing, it is noted that cable 162 extends along three of the four interior corners of outer boom 126. The fourth and last interior corner of outer boom 126 is occupied by ear portion 146.

The position and attachment of the telescopic boom 122 of the pulleys about which cable 162 runs are best seen in FIGS. 16 and 17. The first and second return pulleys 170, 174 are generally parallel and have a bar 176 inserted through their coaxial centers joining them together. The bar 176 is also fastened to a bracket member 178 which is mounted on the exterior surface of outer boom 126 at the outer end thereof opposite the end joined to the boom support member 124 so that return pulleys 170, 174 are located exteriorly of inner boom 128. The bracket member 178 includes an arm 180 overlying the telescopic boom 122 and having a shaft 182 inserted therethrough to connect lateral pulley 172 to the bracket member 178.

Also illustrated in FIG. 16 and 17 is holding pin 184 for connecting inner boom 128 and jib boom 130 together. The holding pin 182 is removable and joins aligned holes in the inner boom 128 and the jib boom 130 so that the jib boom 130 can be extended outwardly from the inner boom 128 to provide additional length to the telescopic boom 122. An aperture 186 is also formed in jib boom 130 adjacent that end to which a rim support member 186 is connected. Rim support member 188 supports rim members 190 between which hook cable 150 is received. Aperture 186 is of a size to receive holding pin 184 when jib boom 130 is substantially contained within inner boom 128. In this position, telescopic boom 122 is relatively shorter in length and jib boom 130 provides greater strength thereto. It is also easily understood that, when inner boom 128 is completely retracted within outer boom 126 and jib boom 130 is completely retracted within inner boom 128, the telescopic boom 122 has even greater strength for lifting and carrying heavy loads.

Based on the foregoing description, a number of worthwhile advantages of the present invention are readily apparent. An improved boom structure is provided which is easily constructed for use by an individual or small business owner such as a farmer, machine shop owner, or small construction contractor where the lifting load requirements are not significantly large. Correspondingly, the cost of the present invention is minimal compared with the larger load carrying cranes used on large construction sites. Additionally, the easy disassembly of the telescopic boom facilitates use of the boom structure in mining operations. The telescopic boom of this invention is pivotally mounted to move through an arc of 180 degrees from a generally horizontal position to facilitate the access thereof to various objects. The circular inner boom with angle irons or face plate connected at the outer surface thereof prevents the turning thereof in the square outer boom. The three cables for the three different described movements are optimally positioned while the winches are adaptable to be powered by a drill or hydraulics for easy movement of the cables. The wheels for supporting the boom support member are laterally movable to provide increased stability when lifting heavy loads. Furthermore, the telescopic boom has extendable and retractable booms to increase the length thereof or provide additional strength when the booms are telescoped together. In one embodiment, the telescopic boom can be fixedly held in position by means of a locking pin inserted into locking holes. Finally, the structure of the boom support member permits it to be mounted on either single or dual axis wheel configurations as well as attached to a multipoint hitch in the back of a tractor.

This invention has been described in detail with reference to a plurality of embodiments thereof, but it will be understood that various modifications can be effected within the spirit and scope of this invention.

I claim:

1. An improved, portable boom structure which can be towed by a vehicle to a work sight, said boom structure comprising:

a boom support member mounted on wheels to facilitate towing of the boom structure;

an elongated frame having one end connected to said boom support member and extending in a generally horizontal direction for towing the boom structure and having means at the opposite end to connect it to a vehicle;

a telescopic boom having an outer end and an inner end and being pivotally connected adjacent said inner end to said boom support member above the axis of the wheels for movement above said frame through a 180 degree arc from a generally horizontal position to a horizontal position in the opposite direction from said boom support member;

cable means connected to said boom support member and extendable from said outer end of said telescopic boom for engaging a load to be lifted; and first means mounted on said boom support member and connected to said telescopic boom to pivot said telescopic boom about said boom support member, said first means including a first winch upper pulley set having a plurality of pulleys mounted adjacent said inner end of said telescopic boom and a first winch lower pulley set having a plurality of pulleys mounted on said boom support member below said first winch upper pulley set, said first winch upper pulley set being arranged to pass over said first winch lower pulley set as said telescopic boom is moved through the 180 degree arc.

2. The boom structure, as claimed in claim 1, further including:

second means mounted on said boom support member and connected to said telescopic boom to extend and retract said telescopic boom.

3. The boom structure, as claimed in claim 1, further including:

third means mounted on said boom support member to extend and retract said cable means.

4. The boom structure, as claimed in claim 1, wherein:

a portion of said frame contains a fluid for use with said first means in pivoting said telescopic boom and which fluid acts as a counterweight when said telescopic boom lifts and carries a load.

5. The boom structure, as claimed in claim 1, wherein said telescopic boom includes:

an outer boom including an outer end and having a generally rectangular cross-section and a first interior corner, a second interior corner, and a third interior corner;

an inner boom including an inner end and having a generally circular cross-section with an outside diameter just sufficiently less than the inside dimensions of said outer boom to be slidably received in said outer boom; and guide means attached to said inner boom for sliding engagement with at least one interior corner of said outer boom to prevent said inner boom from turning in said outer boom.

6. The boom structure, as claimed in claim 5, further including:

second cable means extending along the space adjacent said first interior corner of said outer boom between said outer boom and said inner boom.

7. The boom structure as claimed in claim 6, further including:

an inner pulley attached across said inner end of said inner boom to receive said second cable means from adjacent said second interior corner and direct said second cable means along said third interior corner of said outer boom;

a pair of parallel spaced return pulleys connected adjacent said outer end of said boom; and a lateral pulley connected to said outer boom and positioned generally perpendicular and adjacent to to said return pulleys.

8. The boom structure, as claimed in claim 7, wherein:

said second cable means extends interiorly of said outer boom along the space between said first interior corner thereof and said inner boom, about one of said return pulleys, back to said lateral pulley, back again to the other of said return pulleys, back along the space between said second interior corner of said outer boom and said inner boom, about said inner pulley, and back along the space between said third interior corner of said outer boom and said inner boom, and attaches to said telescopic boom adjacent said outer end of said outer boom.

9. An improved portable boom structure supportable on wheels and connectable to a frame to be towed by a vehicle, said boom structure comprising:

a boom support member;

an outer boom having a generally square cross-section and a first interior corner, a second interior corner, and a third interior corner;

an inner boom having a generally circular cross-section with an outer diameter just sufficiently less than the inside dimension of said outside outer boom to be slidably received therein, said outer boom and said inner boom together forming a telescopic boom pivotally mounted on said boom support member for movement above said frame through a 180 degree arc from a generally horizontal position to a generally horizontally position extending in the opposite direction from said boom support member;

guide means attached to said inner boom section for sliding engagement with at least one interior corner of said outer boom to prevent said inner boom from turning in said outer boom, said guide means including a generally circular face plate engaging the outer surface of said inner boom and an ear portion connected to said face plate and extending adjacent an interior corner of said outer boom other than said first and second interior corners;

a cable extendable from an end of said telescopic boom for lifting a load; and first means mounted on said boom support member and connected to said telescopic boom to pivot said telescopic boom about said boom support member.

10. An improved portable boom structure supportable on wheels and connectable to a frame to be towed by a vehicle, said boom structure comprising:

a boom support member supportable over the wheels;

an outer boom having an outer end, a first interior corner, and a second interior corner and connected to said boom support member;

an inner boom having an inner end slidably received within said outer boom;

an inner pulley attached across said inner end of said inner boom at an oblique angle relative to said inner boom so that said inner pulley is aligned with said first and second interior corners of said outer boom, said first interior corner being diagonally opposite said second interior corner;

first means connected to said boom support member including a first cable means for pivoting said outer and inner booms about said boom structure member; and second means connected to said boom support member including a second cable means for extending and retracting said inner boom and said outer boom, said second cable means extending along said first interior corner between said outer boom and said inner boom, over said inner pulley, back along said second interior corner and attached adjacent said outer end of said outer boom.

11. An improved portable boom structure supportable on wheels and connectable to a frame to be towed by a vehicle, said boom structure comprising:

a boom support member;

an outer boom having a generally square cross section and a first interior corner, a second interior corner, and a third interior corner;

an inner boom having a generally circular cross-section with an outer diameter just sufficiently less than the inside dimension of said outer boom to be slidably received therein, said outer boom and said inner boom together forming a telescopic boom pivotally mounted on said boom support member for movement about the frame through a 180 degree arc from a generally horizontal position to a generally horizontal position extending in the opposite direction from said boom support member;

guide means attached to said inner boom section for sliding engagement with at least one interior corner of said outer boom to prevent said inner boom from turning in said outer boom, said guide means including at least one generally L-shaped angle member connected to the outer surface of said inner boom adjacent an interior corner of said outer boom other than said first and second interior corners, said first interior corner being diagonally opposite second interior corner;

a cable extendable from an end of said telescopic boom for lifting a load; and first means mounted on said boom support member connected to said telescopic boom to pivot said telescopic boom about said boom support member.

* * * * *